US007178346B2

(12) United States Patent
Huang et al.

(10) Patent No.: US 7,178,346 B2
(45) Date of Patent: Feb. 20, 2007

(54) CONSTANT TEMPERATURE REFRIGERATION SYSTEM FOR EXTENSIVE TEMPERATURE RANGE APPLICATION AND CONTROL METHOD THEREOF

(75) Inventors: Eh Dih Huang, Hsinchu County (TW); Wen Ruey Chang, Hsinchu (TW)

(73) Assignee: Industrial Technology Research Institute (TW)

( * ) Notice: Subject to any disclaimer, the term of this patent is extended or adjusted under 35 U.S.C. 154(b) by 0 days.

(21) Appl. No.: 11/288,114

(22) Filed: Nov. 29, 2005

(65) Prior Publication Data

US 2006/0075765 A1 Apr. 13, 2006

Related U.S. Application Data

(62) Division of application No. 10/856,874, filed on Jun. 1, 2004, now Pat. No. 7,000,412.

(30) Foreign Application Priority Data

Dec. 25, 2003 (TW) ..... 92136866 A

(51) Int. Cl.
*F25B 41/00* (2006.01)

(52) U.S. Cl. ..... 62/81; 62/180; 165/247

(58) Field of Classification Search ..... 62/81, 62/96, 97, 99, 203, 333, 209, 498, 180; 165/61, 165/63, 64, 263, 264, 201, 247
See application file for complete search history.

(56) References Cited

U.S. PATENT DOCUMENTS 4,541,248 A * 9/1985 Andrepont et al. ..... 62/48.2
4,707,996 A 11/1987 Vobach
5,083,438 A * 1/1992 McMullin ..... 62/129
5,655,383 A 8/1997 Ferzoco
5,848,532 A 12/1998 Gamble et al.
5,970,729 A 10/1999 Yamamoto et al.
6,389,841 B1 5/2002 Feldman et al.
6,415,858 B1 7/2002 Getchel et al.

(Continued)

FOREIGN PATENT DOCUMENTS

JP 3-181752 A * 8/1991
JP 8-35738 A 2/1996

*Primary Examiner*—Mohammad M. Ali
(74) *Attorney, Agent, or Firm*—Bacon & Thomas PLLC

(57) ABSTRACT

A constant temperature refrigeration system for extensive temperature range application comprising a refrigerator, a low-temperature heat exchanger, a medium-temperature heat exchanger, a high-temperature heat exchanger, a pump, a first solenoid valve, a second solenoid valve, a third solenoid valve, a temperature sensor, a power regulator, a controller and a plurality of heaters, the temperature sensor is utilized for determining the working fluid temperature and compare the actual input temperature, the actual output temperature and the predetermined temperature, and the controller is utilized for switching the first solenoid valve, the second solenoid valve and the third solenoid valve for conveying the fluid to flow through various heat exchangers so that the working fluid is heated or cooled, with the result being that the working fluid temperature outputted is to reach the predetermined temperature, so as to acquire the working fluid having the exactly and precisely predetermined low temperature (−40° C. to 25° C.), medium temperature (25° C. to 50° C.) or high temperature (50° C. to 100° C.).

5 Claims, 18 Drawing Sheets

U.S. PATENT DOCUMENTS 6,427,462 B1 8/2002 Suenaga et al.
6,614,353 B2 * 9/2003 Ozawa ..... 340/585
6,629,423 B1 * 10/2003 Hirooka et al. ..... 62/208
6,659,361 B2 * 12/2003 Sasayama et al. ..... 237/28
6,662,865 B2 * 12/2003 Beitelmal et al. ..... 165/206
6,673,482 B2 1/2004 Imazeki et al.
6,722,145 B2 * 4/2004 Podtchereniaev et al. ..... 62/217
6,749,016 B2 6/2004 Ozawa
6,777,017 B2 8/2004 Porter et al.
6,779,354 B2 * 8/2004 Nakata ..... 62/185
6,783,080 B2 8/2004 Antoniou et al.
6,827,142 B2 * 12/2004 Winkler et al. ..... 165/298
6,843,065 B2 * 1/2005 Flynn ..... 62/156
6,843,069 B2 * 1/2005 Harano et al. ..... 62/185
6,904,968 B2 6/2005 Beitelmal et al.
6,981,385 B2 * 1/2006 Arshansky et al. ..... 62/155
7,000,416 B2 * 2/2006 Hirooka et al. ..... 62/259.2
2004/0123982 A1 7/2004 Chang et al.

* cited by examiner

CONSTANT TEMPERATURE REFRIGERATION SYSTEM FOR EXTENSIVE TEMPERATURE RANGE APPLICATION AND CONTROL METHOD THEREOF

CROSS-REFERENCE TO RELATED APPLICATION

This application is a divisional application of U.S. application Ser. No. 10/856,874, filed Jun. 1, 2004 now U.S. Pat. No. 7,000,412, of which the entire disclosure is hereby incorporated by reference.

BACKGROUND OF THE INVENTION

1. Field of the Invention

The present invention relates to a constant temperature refrigeration system for extensive temperature range application and a control method thereof, more particularly, to a refrigeration system and a method for controlling such refrigeration system; such refrigeration system is for keeping working fluids under constant temperature, and such working fluids are utilized for manufacturing processes in semiconductor, biochemical material, food-processing and original material industries.

2. Description of Related Arts

Refrigeration equipment required by general manufacturing processes usually adopts a coolant compression refrigerator in cooperation with an electrical heating device for automatic compensation, thus achieving the dual functions of heating and cooling, and accurately maintaining the predetermined temperature of working fluids such as coolants, non-freezing liquids, brine or liquid mixtures for manufacturing processes.

The conventional constant temperature refrigeration system 2 is shown in FIG. 21, comprising a tank 20 having an input conduit 27 and an output conduit 28, a pump 26 connected in tandem with the output conduit 28, an evaporator 21 mounted in the tank 20 for providing cooling source, a heater 22 mounted in the tank 20 for providing heat source, a refrigerator connected in tandem with the evaporator 21, including a condenser 23, an inflation valve 24 and a compressor 25 for providing with the coolant loop. The input conduit 27 is for introducing the working fluid into the tank 20, whereas the output conduit 28 is then for outputting the working fluid having exactly the predetermined temperature required by manufacturing processes.

Since the conventional constant temperature refrigeration system 2 utilizes one set of cooling source to proceed to cooling and a set of heat source to proceed to heating compensation, for the evaporator 21 providing the cooling source and the heater 22 providing the heating source are both placed in the identical tank 20, no abnormal operation shall occur for the compressor 25 if applied in manufacturing processes or constant temperature control under smaller heat load. However, for applications under larger heat load for longer periods of time, the design of placing the cooling source and the heating source in the identical tank may easily cause abnormal actuation for high-temperature model compressors.

In addition, general refrigeration systems are usually designed for providing the environmental temperatures under certain low temperature ranges (such as −40° C. to 0° C.), as for applications requiring temperatures high than room temperatures (such as 60° C. to 100° C.), were low-temperature refrigeration systems utilized for maintaining the high-temperature cooling function, electricity shall be wasted, along with tremendous strain on the life time for the compressors because of the huge temperature differences; especially for apparatus in manufacturing processes required to run non-stop 24-hours per day for long periods of time, the energy put into such manufacturing processes shall surely be excessively wasted. For example, the vaporization temperature of the coolant in the conventional refrigeration system 2 shown in FIG. 21 is about −40° C. to 0° C., but if under high-temperature operation, the coolant drawn back to the compressor 25 shall be overheated to even reach 70° C. to 100° C., thus causing the conduit to be under high-pressure state for such overheated coolant is drawn therein, and then the efficiency for the compressor 25 to draw in the coolant is reduced to the extent that the coolant might not even be drawn smoothly back into the compressor 25, thus causing the refrigeration system 2 to lose the equilibrium and therefore the normal operation of the overall refrigeration system is endangered, a result shall cause serious delay of production.

Please refer to FIG. 1, which shows a constant temperature refrigeration system for extensive temperature range application, a U.S. application Ser. No. 10/331,991 owned by the Applicant. Such constant temperature refrigeration system for extensive temperature range application 10 comprises a refrigerator R, a low-temperature heat exchanger LHX, a medium-temperature heat exchanger MHX, a high-temperature heat exchanger HHX, a pump P, a first solenoid valve SV1, a second solenoid valve SV2, a third solenoid valve SV3, a temperature sensor TS1, a power regulator SSR and a controller C.

The medium-temperature heat exchanger MHX and the high-temperature heat exchanger HHX are both placed in a tank 11 mounted at the input end IN, and the tank 11, the pump P and the conduit of the output end OUT are connected in tandem with the first solenoid valve SV1, whereas the second solenoid valve SV2 is connected in tandem on the conduit of the medium-temperature heat exchanger MHX, and whereas the third solenoid valve SV3 is connected in tandem on the conduit of the low-temperature heat exchanger LHX while connecting in parallel with the first solenoid valve SV1. The refrigerator R is connected in tandem with the low-temperature heat exchanger LHX.

The power regulator SSR is electrically connected to the high-temperature heat exchanger HHX, an A.C. power source and the controller C, respectively. The temperature sensor TS1 is mounted in the controller C, which is electrically connected to the first solenoid valve SV1, the second solenoid valve SV2 and the third solenoid valve SV3, respectively, and the temperature sensor TS1 is connected to the input end IN and the output end OUT, so as to detect the temperature T2 of the input end IN and the temperature T1 of the output end OUT. The electrical connection circuits in drawings are represented by the dotted lines therein.

The power regulator SSR is to regulate the load of the high-temperature heat exchanger HHX, and the temperature sensor TS1 is utilized for predetermining the output temperature of the working fluid. The controller is utilized for controlling the first solenoid valve, the second solenoid valve and the third solenoid valve for conveying the fluid to various heat exchangers so that the working fluid is heated or cooled.

The working fluid can be coolants, non-freezing liquids, brine or liquid mixtures, and the working fluid is introduced in the tank 11 via the input end IN and outputted driven by the pump P through the first solenoid valve SV1 via the output end OUT, and through the third solenoid valve SV3 and the low-temperature LHX via the output end OUT.

The refrigerator R provides the cooling source below 25° C. for the low-temperature heat exchanger LHX. The facility water FW can be ice water with temperature thereof being higher than room temperature of 25° C., and such facility water FW flows through the second solenoid valve SV2 and the medium-temperature heat exchanger MHX so as to provide the medium temperature cooling source. The high-temperature heat exchanger HHX is constantly under "ON" state as the refrigeration system 10 is actuated, and the power regulator SSR is utilized for fine-tuning the temperature with reference to the temperature difference signals from the temperature sensor TS1, so as to provide temperature compensation.

The first embodiment of the controlling method on the refrigeration system 10 is elaborated in accordance with FIG. 1 to FIG. 7 as follows.

At first, the working fluid temperature required by the refrigeration system 10 is predetermined, then the pump P is actuated for inputting the working fluid and the facility water FW into the refrigeration system 10; the predetermined temperature, the actual inputting temperature T2 of the working fluid and the actual outputting temperature T1 of the working fluid from the temperature sensor TS 1 are then read (since the predetermined temperature is set by the temperature sensor TS1, the predetermined temperature is represented by TS1) and compared, with the result of such comparison being utilized for heating or cooling the working fluid so as to cause the working fluid to reach the predetermined temperature.

More specifically, when comparing the predetermined temperature TS1, the actual inputting temperature T2 of the working fluid and the actual outputting temperature T1 of the working fluid, if T1 is higher than TS1, and TS1 is higher than T2, the cooling model is proceeded, at this time the difference between the outputting temperature T1 and the inputting temperature TS1 continues to be read to determine if such difference is smaller than the error value $\epsilon$ (+0.1° C. to −0.1° C.). If such difference is still larger than the error value $\epsilon$, the cooling model then proceeds continuously; if smaller, the heating model is then employed instead such that the outputting temperature T1 of the working fluid is to reach the predetermined temperature TS1 so as to maintain the temperature of the working fluid under constant temperature state within the error value, which is shown in FIG. 7. No elaboration is required for other controlling models for comparing T1, TS1 and T2.

The foregoing cooling model and the heating model are elaborated further as follows by referring to FIG. 4 and FIG. 6 in accordance with FIG. 1.

As shown in FIG. 4, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the third solenoid valve SV3 and the low-temperature heat exchanger LHX, and eventually discharged through the output end OUT; as the refrigeration system 10 is for medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, then channeled by conduits to flow through the first solenoid valve SV1 and eventually discharged through the output end OUT.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, then heated by the high-temperature heat exchanger HHX, and then channeled by conduits to flow through the first solenoid valve SV1 and eventually discharged through the output end OUT.

Shown in FIG. 2, the second embodiment of the constant temperature refrigeration system 10 for extensive temperature range application of the present invention comprises a refrigerator R, a low-temperature heat exchanger LHX, a medium-temperature heat exchanger MHX, a high-temperature heat exchanger LHX, a pump P, a first solenoid valve SV1, a second solenoid valve SV2 and a third solenoid valve SV3. The power regulator, the temperature sensor and the controller are all omitted in FIG. 2 for the means of electrical connections thereof are all identical to that in FIG. 1.

As shown in FIG. 2, the high-temperature heat exchanger HHX and the pump P are both mounted at the output end, with the conduit thereof being connected in tandem thereon with the first solenoid valve SV1, whereas the second solenoid valve SV2 is connected in tandem on the conduit of the medium-temperature heat exchanger MHX while connecting in parallel with the first solenoid valve SV1, and whereas the third solenoid valve SV3 is connected in tandem on the conduit of the low-temperature heat exchanger LHX while connecting in parallel with the first solenoid valve SV1.

The controlling method for the second embodiment of the constant temperature refrigeration system 10 for extensive temperature range application of the present invention is identical to that in FIG. 7 with the elaboration thereof being found in that of the first embodiment. However, the cooling model and the heating model of the second embodiment are elaborated further in accordance with FIG. 2, FIG. 5 and FIG. 6.

As shown in FIG. 5, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the third solenoid valve SV3, the low-temperature heat exchanger LHX and the high-temperature heat exchanger HHX, and eventually discharged through the output end OUT; as the refrigeration system 10 is for medium-temperature or high-temperature application, the controller C is to switch the first solenoid valve SV1 as OFF, the second solenoid valve SV2 as ON, the third solenoid valve SV3 as OFF and the high-temperature heat exchanger HHX as ON, subsequently the working fluid is introduced into the tank 11 via the input end IN, then channeled by conduits to flow through the second solenoid valve SV2, the medium-temperature heat exchanger MHX and the high-temperature heat exchanger HHX, and eventually discharged through the output end OUT.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, and then channeled by conduits to flow through the first solenoid valve SV1 and the high-temperature heat exchanger HHX, and eventually discharged through the output end OUT.

FIG. 3 shows the third embodiment of the constant temperature refrigeration system 10 for extensive temperature range application of the present invention, wherein the design is identical to that of the second embodiment except for the pump P and the high-temperature heat exchanger HHX being both mounted at the input end IN.

The controlling method for the third embodiment of the constant temperature refrigeration system 10 for extensive temperature range application of the present invention is identical to that of the first embodiment, so that it is not repeated herein. However, the cooling model and the heating model of the third embodiment are elaborated further in accordance with FIG. 3, FIG. 5 and FIG. 6.

As shown in FIG. 5, as the working fluid inputted is about to be cooled, the predetermined temperature TS1 is detected first, and then, as the refrigeration system 10 is for low-temperature application, the controller C is to switch the first solenoid valve SV1 as OFF, the second solenoid valve SV2 as OFF, the third solenoid valve SV3 as ON and the high-temperature heat exchanger HHX as ON, subsequently the working fluid is introduced into the tank 11 via the input end IN, then channeled by conduits to flow through the high-temperature heat exchanger HHX, the third solenoid valve SV3 and the low-temperature heat exchanger LHX, and eventually discharged through the output end OUT; as the refrigeration system 10 is for medium-temperature or high-temperature application, the controller C is to switch the first solenoid valve SV1 as OFF, the second solenoid valve SV2 as ON, the third solenoid valve SV3 as OFF and the high-temperature heat exchanger HHX as ON, subsequently the working fluid is introduced into the tank 11 via the input end IN, then channeled by conduits to flow through the high-temperature heat exchanger HHX, the second solenoid valve SV2 and the medium-temperature heat exchanger MHX, and eventually discharged through the output end OUT.

As shown in FIG. 6, as the working fluid inputted is about to be heated with the refrigeration system 10 being for low-temperature, medium-temperature or high-temperature application, the controller C is to switch the first solenoid valve SV1 as ON, the second solenoid valve SV2 as OFF, the third solenoid valve SV3 as OFF and the high-temperature heat exchanger HHX as ON, subsequently the working fluid is introduced into the tank 11 via the input end IN, and then channeled by conduits to flow through the high-temperature heat exchanger HHX and the first solenoid valve SV1, and eventually discharged through the output end OUT.

However, while under the medium temperature (25° C. to 50° C.) or high temperature (50° C. to 100° C.) as in FIG. 3, the cooling model thereof is that the first solenoid valve SV1 is in OFF mode, the second solenoid valve SV2 is in ON mode, and the third solenoid valve SV3 is in OFF mode, with the instant cooling process being completed via the facility water under 25° C. through the medium-temperature heat exchanger MHX. Yet, if the heat load of the working fluid becomes too high, the medium-temperature heat exchanger MHX then might fail to lower the temperature, which means when the heat load of the working fluid is greater than the heat exchanging capacity of the medium-temperature heat exchanger MHX, the temperature of the working fluid would be higher and higher without being able to be controlled under constant temperature. In addition, while under the low temperature (−40° C. to 25° C.), cooling model thereof is that the first solenoid valve SV1 is in OFF mode, the second solenoid valve SV2 is in OFF mode, and the third solenoid valve SV3 is in ON mode, which means the cooling process is completed by the low-temperature heat exchanger LHX. Yet since the 25° C. facility water is still kept in the medium-temperature heat exchanger MHX, as the control temperature is near the low temperature, the temperature of the facility water in the medium heat exchanger MHX would be lower and lower because of the heat conduction to the point where the control temperature is near −40° C., such that the temperature of the facility water in the medium heat exchanger MHX would be lower than 0° C., thus causing the facility water to be frozen so as to cause the medium-temperature heat exchanger MHX to cracks and damages.

In view of the object to improve upon the U.S. patent application Ser. No. 10/331,991, the present invention provides that a heat source is disposed at the outlet/inlet of the cooling end of the medium-temperature heat exchanger so as to interrupt the heat conduction of the working fluid during low temperature, thus preventing the temperature of the cooling water at the cooling end from being lowered to under 0° C., being frozen, and thus causing damages on the medium-temperature heat exchanger. Therefore, the present invention provides a more stable system and thus the time span for use of such system can be prolonged.

SUMMARY OF THE INVENTION

The primary object of the present invention is to provide a constant temperature refrigeration system for extensive temperature range application, which applies the facility water usually prepared in general semiconductor processes, biochemical material, food-processing and original material industries, and the refrigeration system thereof such as liquid chillers and cooling towers, in accordance with conduits and certain solenoid valves, so that as different solenoid valves are switched ON or OFF according to different temperature requirement, so as to acquire the working fluid having the exactly and precisely predetermined low temperature (−40° C. to 25° C.), medium temperature (25° C. to 50° C.) or high temperature (50° C. to 100° C.) required during various industrial manufacturing processes, a design that provides users with the energy-saving function and system maintenance for normal operations.

The constant temperature refrigeration system for extensive temperature range application capable of providing the foregoing functions comprises a refrigerator, a low-temperature heat exchanger, a medium-temperature heat exchanger, a high-temperature heat exchanger, a pump, a first solenoid valve, a second solenoid valve, a third solenoid valve, a temperature sensor, a power regulator and a controller, the refrigerator, the low-temperature heat exchanger, the medium-temperature heat exchanger, the high-temperature heat exchanger, the pump, the first solenoid valve, the second solenoid valve and the third solenoid valve being connected via conduits and being mounted with an input end and an output end, a working fluid being introduced therein via the input end and driven thereout via the output end by the pump, the power regulator being utilized for regulating the load carried by the high-temperature heat exchanger, the temperature sensor being utilized for predetermining the output temperature of the working fluid, the controller being utilized for controlling on/off of the first solenoid valve, the second solenoid valve and the third solenoid valve for conveying the fluid to various the heat exchangers to heat or cool the working fluid, with the result being that the temperature of the working fluid outputted being caused to reach the predetermined temperature, thus achieving the constant temperature control. The pump is connected with three circuits in parallel, with the first circuit being jointed with the first solenoid valve in parallel and then connected to the outlet end of the working fluid, the second circuit being jointed with the second solenoid valve in parallel and then connected to the medium-temperature heat exchanger in tandem, and the third circuit being jointed with the third solenoid valve in parallel and then connected to the medium-temperature heat exchanger in tandem and then connected to the outlet end of the working fluid.

Preferably, the medium-temperature heat exchanger and the high-temperature heat exchanger are both placed in a tank mounted at the input end, and the tank, the pump and the conduit of the output end are connected in tandem with the first solenoid valve, whereas the second solenoid valve is connected in tandem on the conduit of the medium-temperature heat exchanger, and whereas the third solenoid valve is connected in tandem on the conduit of the low-temperature heat exchanger while connecting in parallel with the first solenoid valve.

Preferably, the high-temperature heat exchanger and the pump are both mounted at the output end, with the conduit thereof being connected in tandem with the first solenoid valve thereon, the second solenoid valve is connected in tandem on the conduit of the medium-temperature heat exchanger while connecting in parallel with the first solenoid valve, whereas the third solenoid valve is connected in tandem on the conduit of the low-temperature heat exchanger while connecting in parallel with the first solenoid valve. Heaters are respectively disposed at the outlet and inlet of the cooling end of the medium-temperature heat exchanger.

Preferably, the high-temperature heat exchanger and the pump are both mounted at the input end, with the conduit thereof being connected in tandem with the first solenoid valve thereon, whereas the second solenoid valve is connected in tandem on the conduit of the medium-temperature heat exchanger while connecting in parallel with the first solenoid valve, and whereas the third solenoid valve is connected in tandem on the conduit of the low-temperature heat exchanger while connecting in parallel with the first solenoid valve. Heaters are respectively disposed at the outlet and inlet of the cooling end of the medium-temperature heat exchanger.

Preferably, the working fluid is coolant, non-freezing solution, brine or liquid mixture for the manufacturing process.

Preferably, each circuit of the heater is connected in tandem with a temperature switch that respectively attaches onto the outer surface of the outlet and inlet of the cooling end of the medium-temperature heat exchanger.

Preferably, the heaters respectively disposed at the outlet and inlet of the cooling end of the medium-temperature heat exchanger can operate independently.

Preferably, the heaters respectively disposed at the outlet and inlet of the cooling end of the medium-temperature heat exchanger are connected in tandem and connected in parallel to the outlet end of the condenser of the refrigerator.

The other object of the present invention is to provide a method for controlling the constant temperature refrigeration system for extensive temperature range application, whereby the working fluid temperature is predetermined and the actual input temperature, the actual output temperature and the predetermined temperature are compared, subsequently the first solenoid valve, the second solenoid valve and the third solenoid valve are switched ON or OFF according to the foregoing comparison for conveying the fluid to various heat exchangers, so that the working fluid is heated or cooled, with the result being that the working fluid temperature outputted is to reach the predetermined temperature, so as to acquire the working fluid having the exactly and precisely predetermined low temperature (−40° C. to 25° C.), medium temperature (25° C. to 50° C.) or high temperature (50° C. to 100° C.) required during various industrial manufacturing processes.

The method for controlling a constant temperature refrigeration system for extensive temperature range application capable of achieving the foregoing function comprises steps as follows:

a. Predetermine the temperature of the working fluid needed for the refrigeration system;
b. Actuate the pump whereby the working fluid and the facility water are respectively introduced into the refrigeration system;
c. Compare the temperature differences between the inputting temperature, the outputting temperature and the predetermined temperature by the temperature sensor;
d. Transmit signals of the temperature differences to the controller for controlling the first, second and third solenoid valves such that the working fluid is to flow through the low, medium and high temperature heat exchangers; and
e. Heat or cool the working fluid through controlling the first, second and third solenoid valves, such that the temperature of the working fluid outputted is to reach the predetermined temperature required by manufacturing processes.

Preferably, a refrigerator is utilized for providing a cooling source with temperature lower than 25° C. during low-temperature application, such that heat energy generated during the manufacturing process may be brought away under the low-temperature environment for the energy-saving purpose.

Preferably, the facility water having the temperature higher than 25° C. is utilized during medium-temperature application, such that power utilized during temperature control over 25° C. may be reduced for the energy-saving purpose.

Preferably, a high-temperature heat exchanger is utilized during high-temperature application, the high-temperature heat exchanger being constantly under the "ON" state after the refrigeration system is actuated, and the power regulator is utilized for fine-tuning the temperature with reference to the temperature differences from the temperature sensor, so as to achieve accurate constant temperature control.

Preferably, as the temperature requirement for the working fluid to be medium or high temperature, the refrigerator in the refrigeration system is intermittently turned on and off so as to assure the smooth operation of the refrigeration system under wider range of temperature conditions in the long haul.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the inventions.

Figure 1:
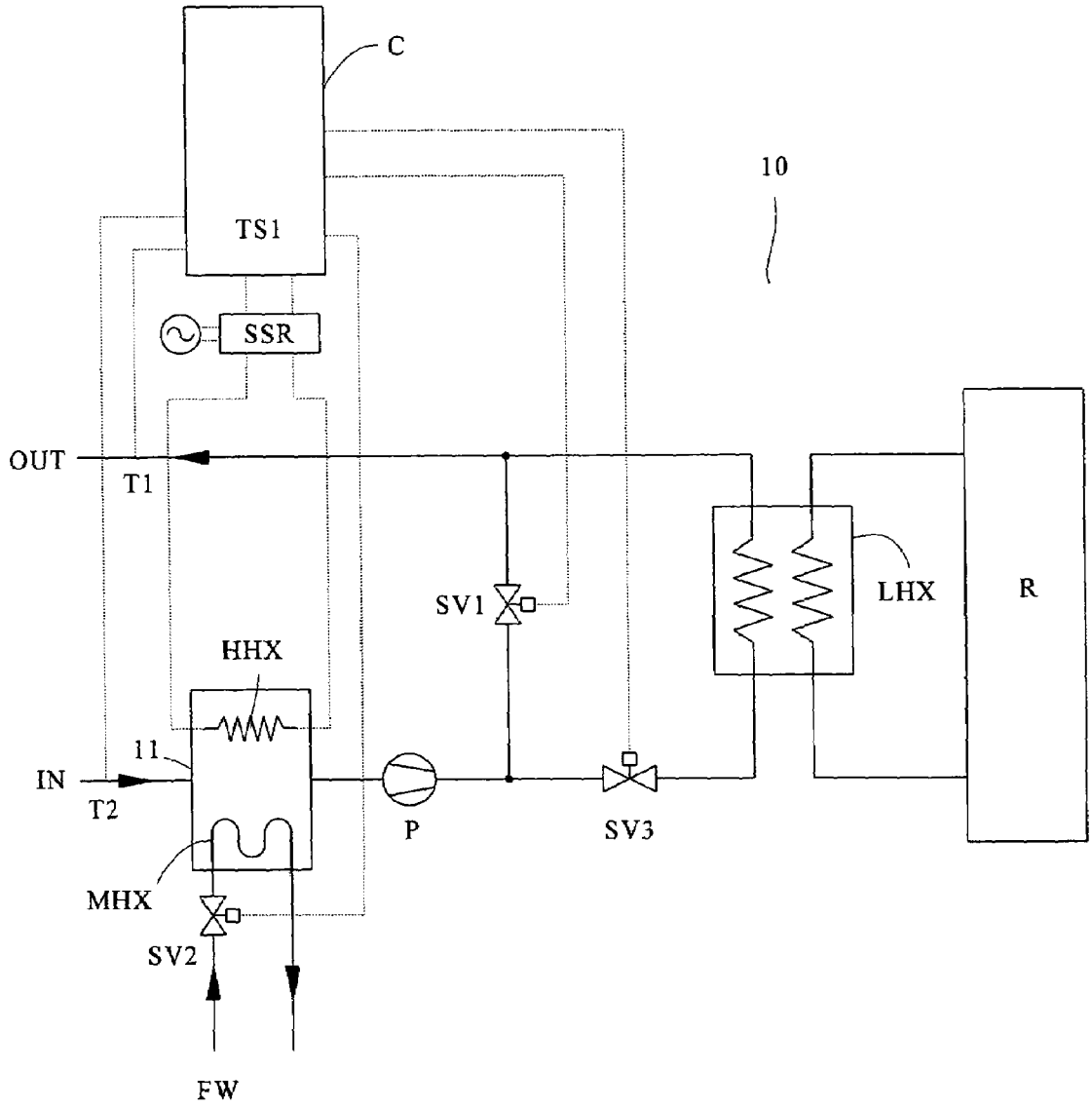
FIG. 1 shows a plot plan of the first exemplary constant temperature refrigeration system for extensive temperature range application utilizing the conventional controlling method.
Figure 2:
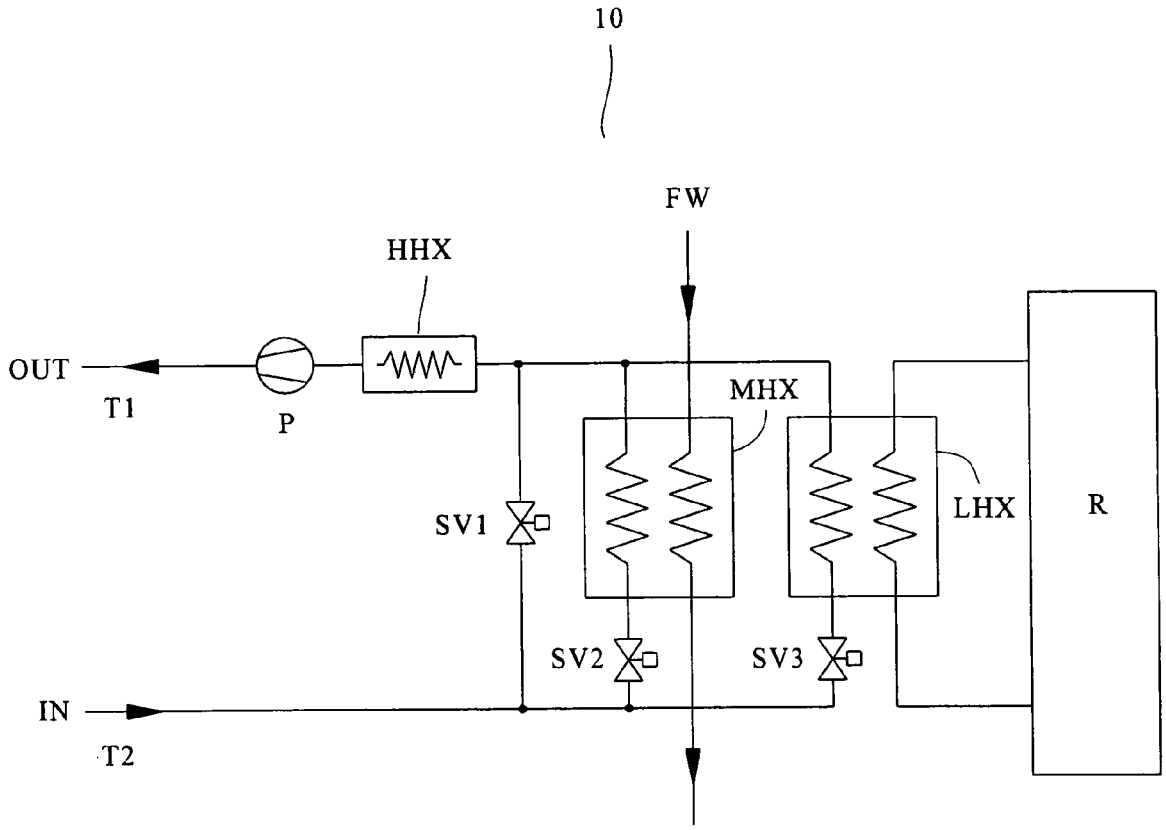
FIG. 2 shows a plot plan of the second exemplary constant temperature refrigeration system for extensive temperature range application utilizing the conventional controlling method.
Figure 8:
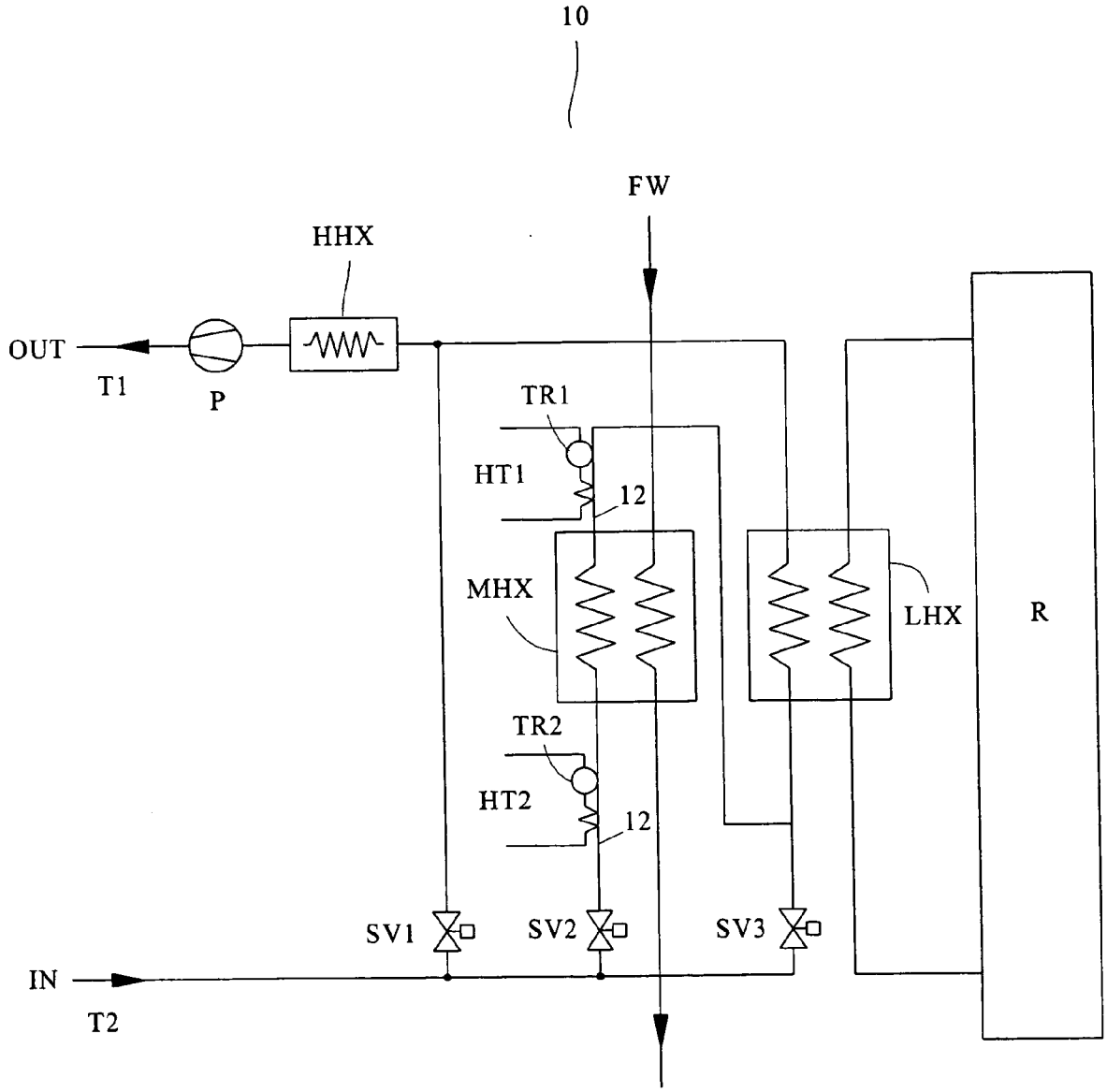
FIG. 8 shows a plot plan of a constant temperature refrigeration system for extensive temperature range application controlled by the present controlling method according to the first embodiment of the present invention, which is similar to the second example shown in FIG. 2.

FIG. 8 shows a plot plan of a constant temperature refrigeration system 10 for extensive temperature range application controlled by the present controlling method according to the first embodiment of the present invention, which is similar to the second example shown in FIG. 2, comprising a refrigerator R, a low-temperature heat exchanger LHX, a medium-temperature heat exchanger MHX, a high-temperature heat exchanger LHX, a pump P, a first solenoid valve SV1, a second solenoid valve SV2 and a third solenoid valve SV3, heaters HT1 and HT2, and temperature switches TR1 and TR2. The power regulator, the temperature sensor and the controller are all omitted in FIG. 8 for the means of electrical connections thereof are all identical to those in FIG. 1.

As shown in FIG. 8, the high-temperature heat exchanger HHX and the pump P are both mounted at the output end, with the conduit thereof being connected in tandem thereon with the first solenoid valve SV1, whereas the second solenoid valve SV2 is connected in tandem on the conduit of the medium-temperature heat exchanger MHX while connecting in parallel with the first solenoid valve SV1, and whereas the third solenoid valve SV3 is connected in tandem on the conduit of the low-temperature heat exchanger LHX while connecting in parallel with the first solenoid valve SV1, and the conduit for the outlet of the cooling end of the medium-temperature heat exchanger MHX is connected to the conduit of the low-temperature heat exchanger LHX and the third solenoid valve SV3. The heaters HT1 and HT2 are respectively disposed at the outlet and inlet of the cooling end of the medium-temperature heat exchanger MHX, with each circuit of the heaters HT1 and HT2 being connected in tandem with the temperature switch TR1 and TR2 that respectively attach onto the outer surface of the outlet and inlet wall 12 of the cooling end of the medium-temperature heat exchanger MHX.

The refrigerator R provides the cooling source below 25° C. for the low-temperature heat exchanger LHX. While under the medium temperature (25° C. to 50° C.) or high temperature (50° C. to 100° C.), the cooling model thereof is that the first solenoid valve SV1 is in OFF mode, the second solenoid valve SV2 is in ON mode, and the third solenoid valve SV3 is in OFF mode, and since the medium-temperature heat exchanger MHX is connected to the low-temperature heat exchanger LHX in tandem, as the load is huge, the working fluid is to flow through the medium-temperature heat exchanger MHX first for cooling, and then flow through the low-temperature heat exchanger LHX for further cooling.

While under the low temperature (−40° C. to 25° C.), cooling model thereof is that the first solenoid valve SV1 is in OFF mode, the second solenoid valve SV2 is in OFF mode, and the third solenoid valve SV3 is in ON mode, which means the cooling process is completed by the low-temperature heat exchanger LHX.

While under the low temperature (−40° C. to 25° C.), the heaters HT1 and HT2 are respectively controlled by the temperature switches TR1 and TR2. The temperature switches TR1 and TR2 would switch to ON mode as the predetermined temperature is sensed thereby to be lower than that of the temperature switches, such that the heaters HT1 and HT2 begin to provide heat, whereas the temperature switches TR1 and TR2 would switch to OFF mode as the predetermined temperature is sensed thereby to be higher than that of the temperature switches, and the heaters HT1 and HT2 are not actuated, so as to interrupt the heat conduction of the working fluid and thus keep the temperature of the medium-temperature heat exchanger MHX to be higher than 0° C., therefore the facility water FW remained in the medium-temperature heat exchanger MHX would be free from being frozen.

Figure 21:
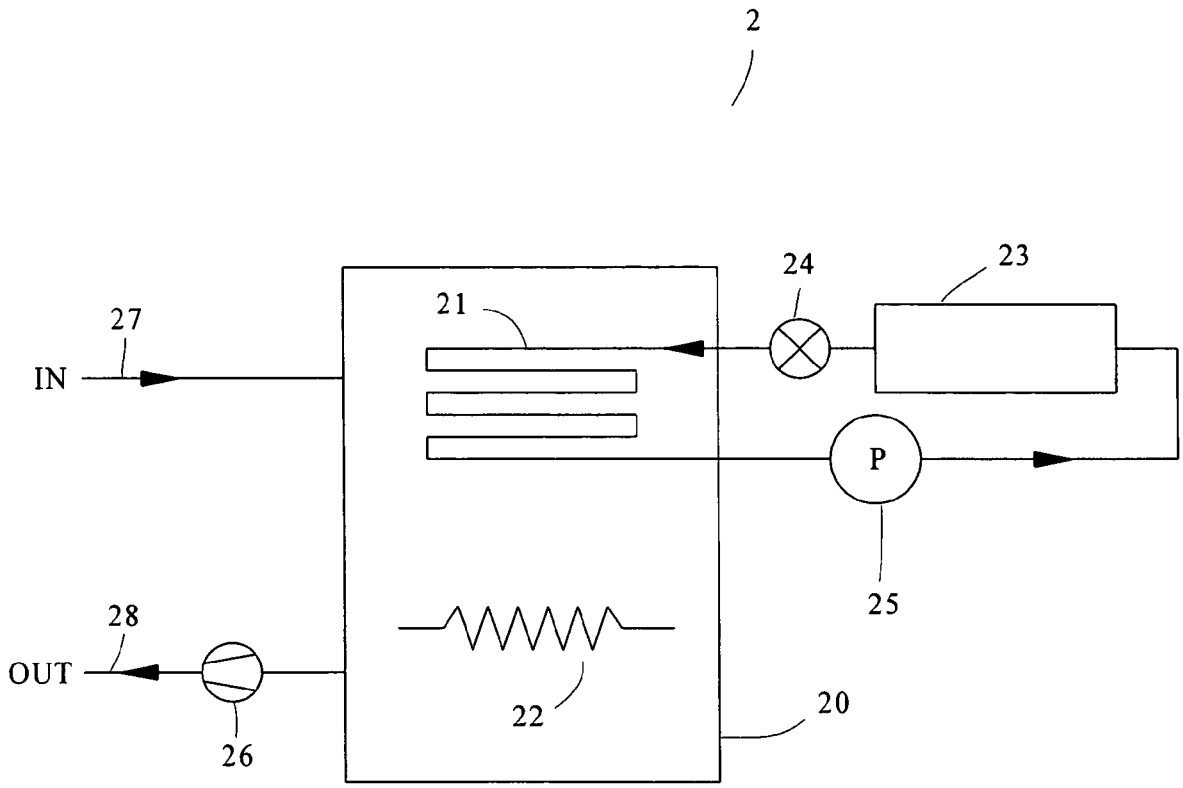
FIG. 21 shows a plot plan of a conventional constant temperature refrigeration system.

As shown in FIG. 8, the heaters HT1 and HT2 is powered via AC power source, yet both can be powered by the heat generated by a condenser R1 of the refrigerator R (the condenser 23 in FIG. 21) without necessarily requiring AC power.

Figure 9:
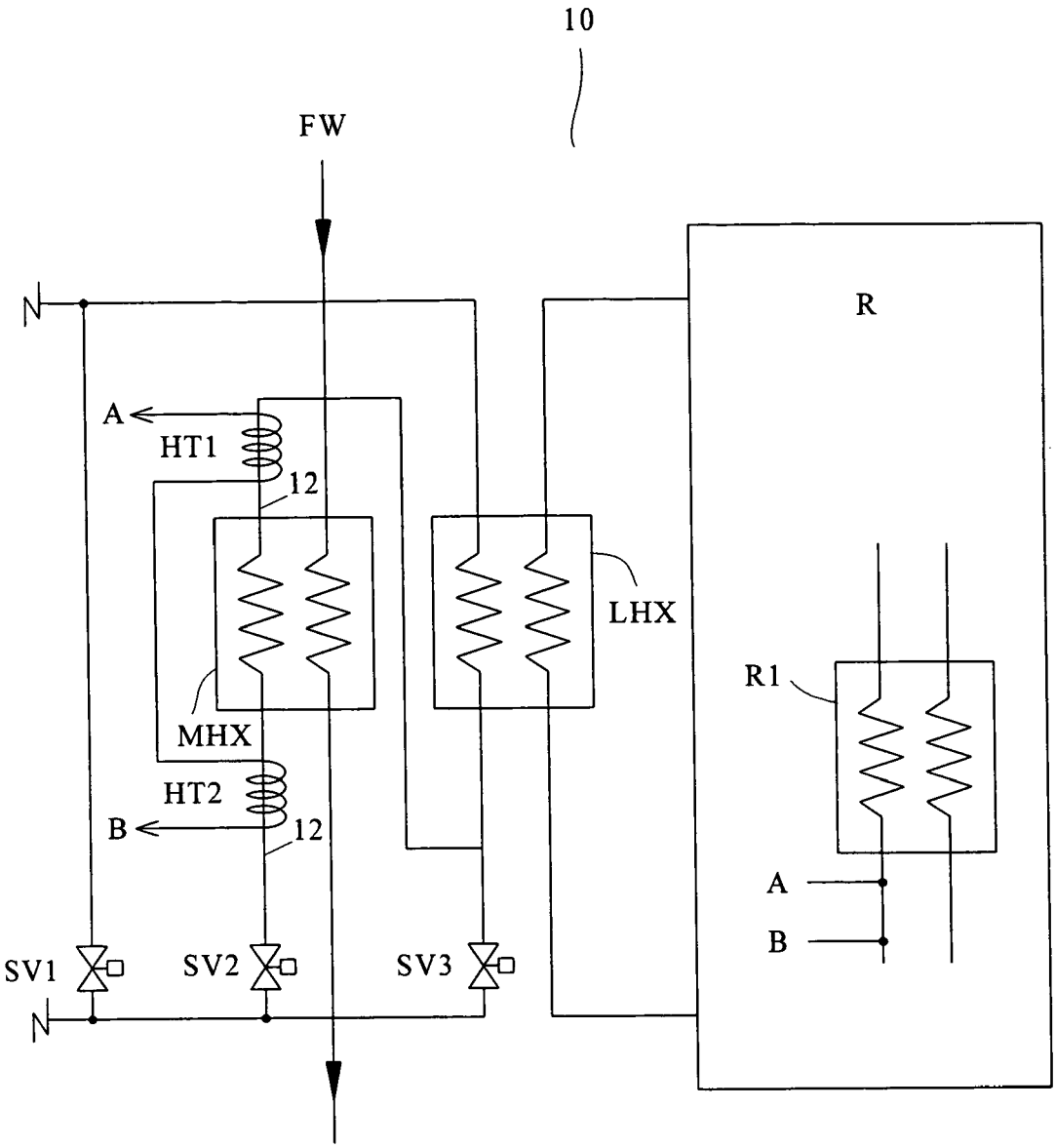
FIG. 9 shows another embodiment shown in FIG. 8.

Please refer to FIG. 9, which shows another embodiment shown in FIG. 8, wherein the first heater HT1 and the second heater HT2 formed by spiral conduits are wrapped on and attached to the outer surface of the outlet and inlet wall of the cooling end of the medium-temperature heat exchanger MHX. Both heaters HT1 and HT2 are connected in tandem and are connected in parallel via the condensing tubes A and B to the outlet end of the condenser R1 of the refrigerator R, so as to use the temperature of the fluid in the condensing tubes A and B to interrupt the heat conduction of the facility water FW in the outlet and inlet conduits of the medium-temperature heat exchanger MHX.

Figure 10:
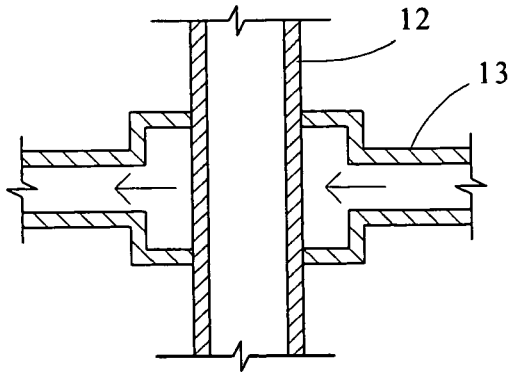
FIG. 10 shows another embodiment shown in FIG. 9.

Please refer to FIG. 10, which shows another embodiment of FIG. 9. As the above application of the fluid temperature in the condensing tubes A and B of the condenser R1 of the refrigerator R, the fluid temperature also can be conducted on the outer surface of the outlet and inlet walls of the tube 12 of the cooling end of the medium-temperature heat exchanger MHX. As shown in FIG. 10, the condensing tubes A and B are tightly attached to the outer surface of the tube 12 by joints 13 so as to the fluid in the condensing tubes A and B pass through the outer surface of the tube 12 to directly conduct the fluid temperature onto the tube 12 so as to interrupt the heat conduction of the facility water FW in the outlet and inlet conduits of the medium-temperature heat exchanger MHX.

Figure 3:
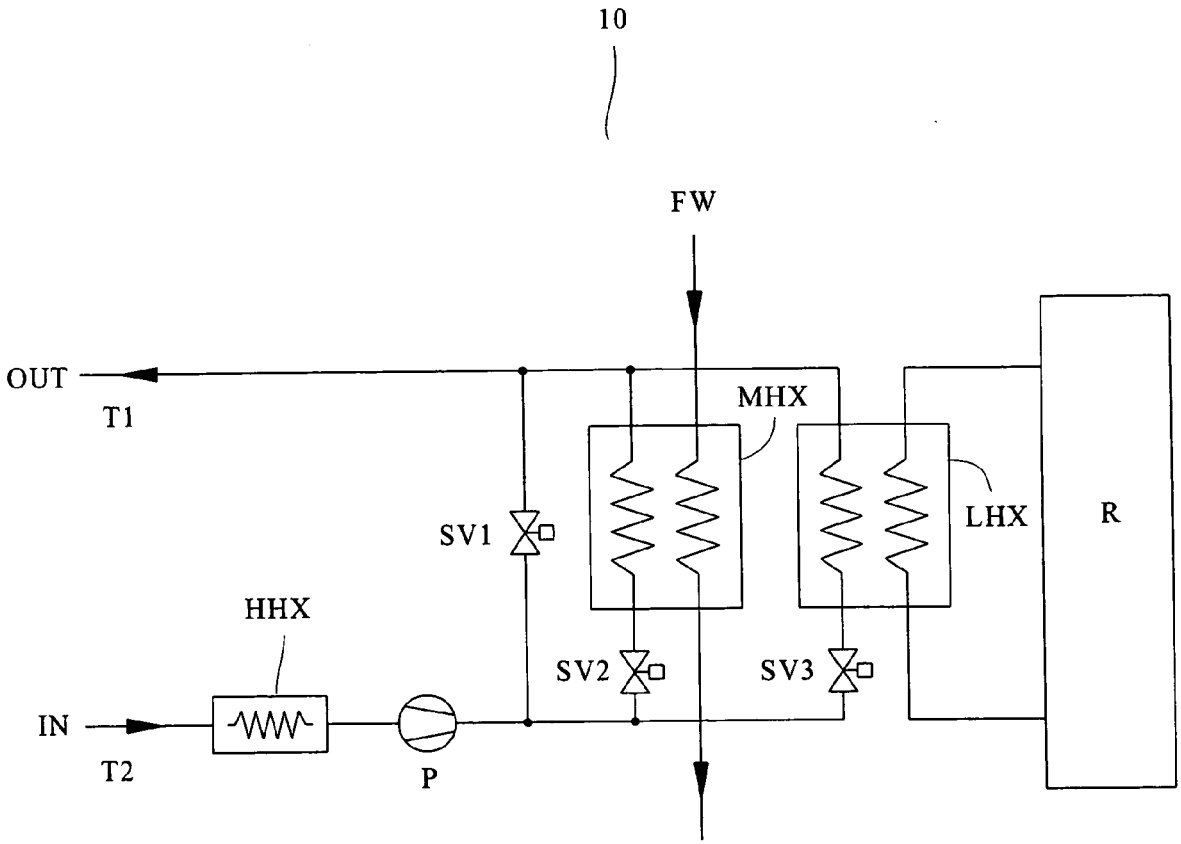
FIG. 3 shows a plot plan of the third exemplary constant temperature refrigeration system for extensive temperature range application utilizing the conventional controlling method.
Figure 4:
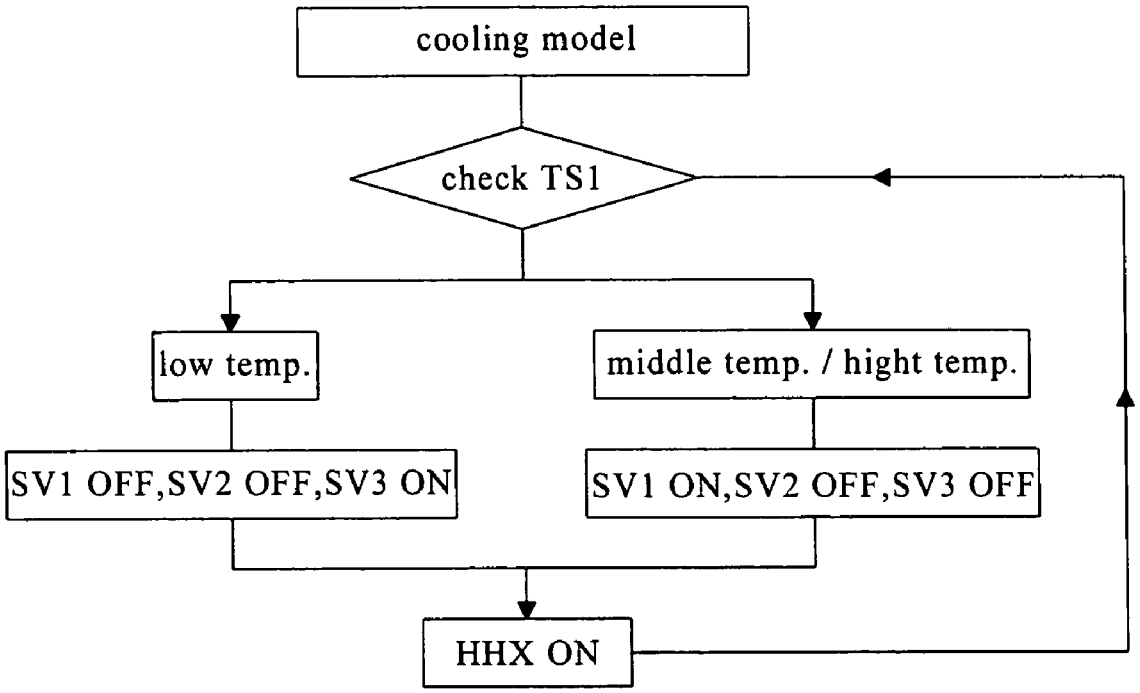
FIG. 4 shows a flow chart of the cooling model for the conventional controlling method, which is applied in the first example shown in FIG. 1.
Figure 5:
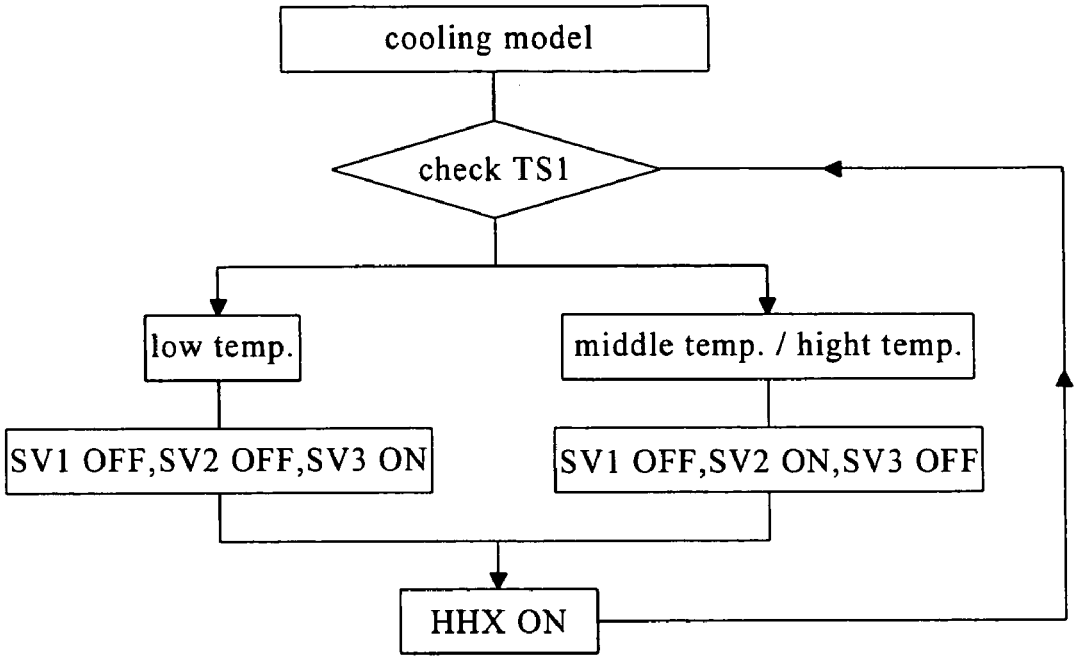
FIG. 5 shows a flow chart of another cooling model for the conventional controlling method, which is applied in the second example shown in FIG. 2, the third example shown in FIG. 3, the first embodiment in FIG. 8 and the second embodiment in FIG. 11.
Figure 6:
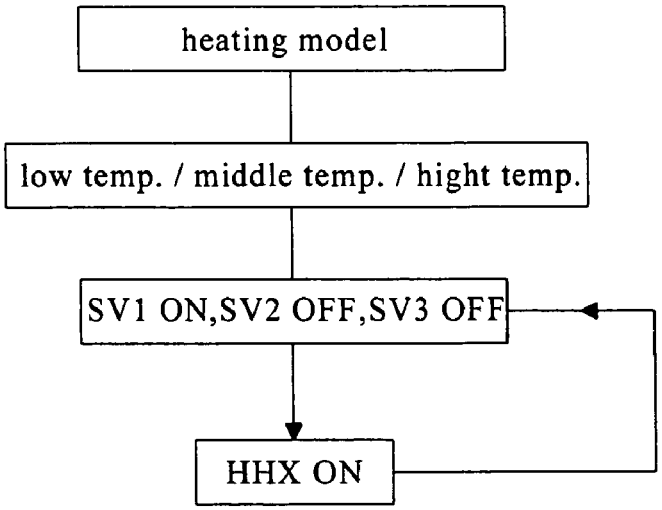
FIG. 6 shows a flow chart of a heating model for the conventional controlling method, which is applied in the first embodiment in FIG. 1, the second embodiment shown in FIG. 2, the third embodiment shown in FIG. 3, the first embodiment in FIG. 8 and the second embodiment in FIG. 11.
Figure 7:
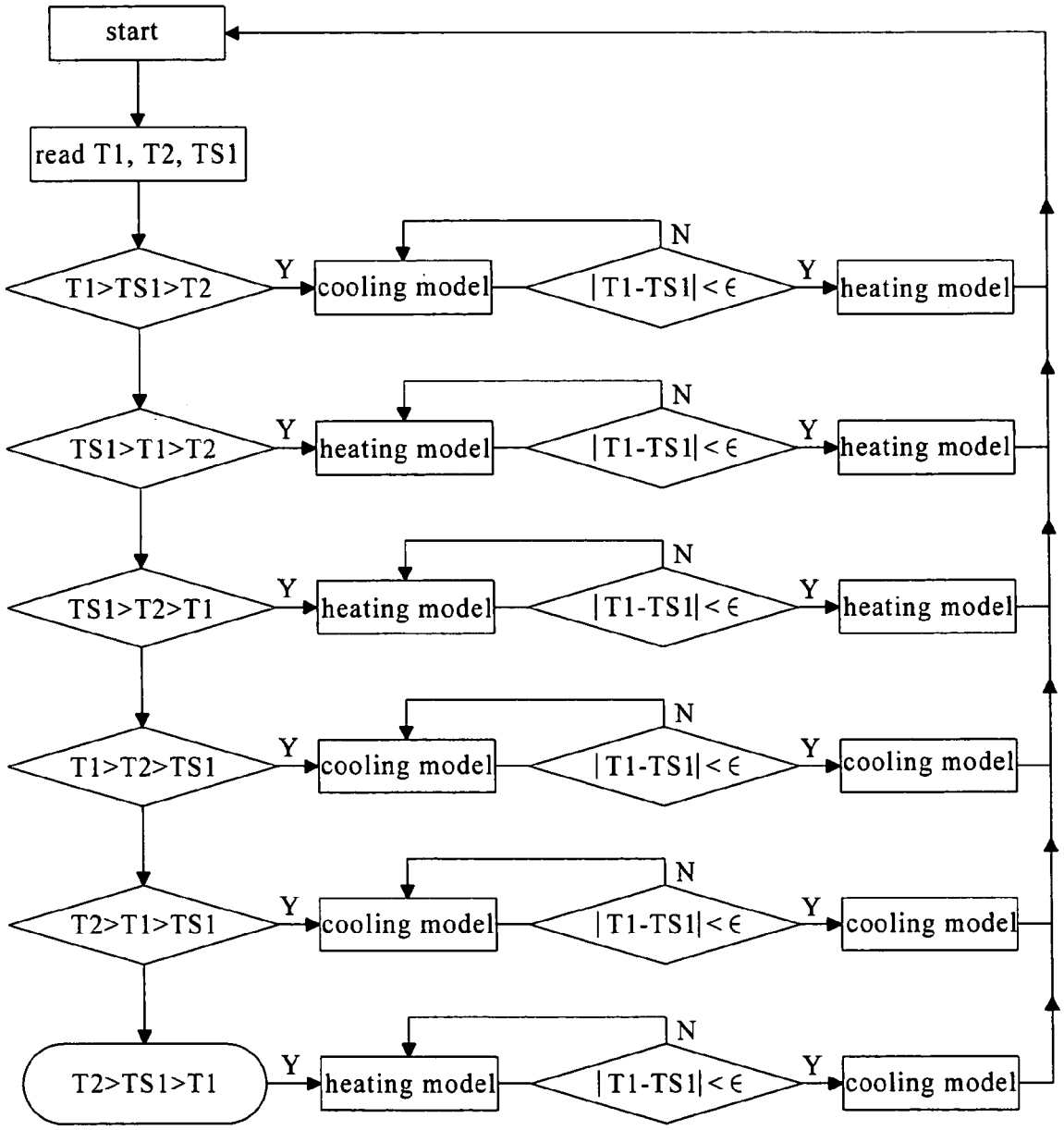
FIG. 7 shows a flow chart for the conventional controlling method.
Figure 11:
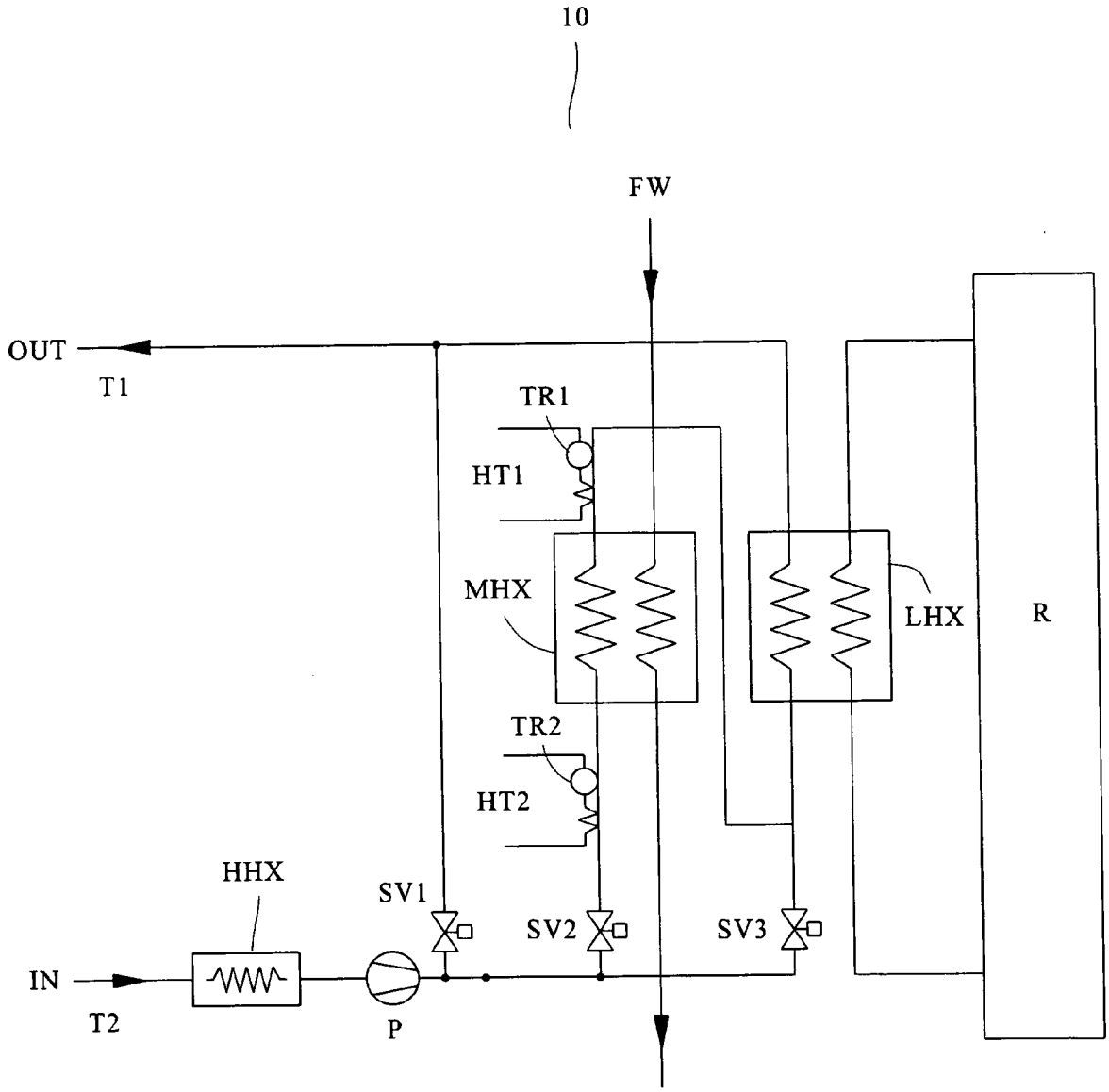
FIG. 11 shows a plot plan of a constant temperature refrigeration system for extensive temperature range application controlled by the present controlling method according to the second embodiment of the present invention, which is similar to the third example shown in FIG. 3.

Please continue refer to the second embodiment in FIG. 11, which is similar to the third example shown in FIG. 3, and since the heaters HT1 and HT2 and the temperature switches TR1 and TR2 function identically to those in the first example of FIG. 1, they are not to be repeated herein.

As for the controlling methods for constant temperature shown respectively in FIG. 8 and FIG. 11 ,which are the heating and cooling models and procedures thereof, since they are identical to those in the examples shown in FIG. 2 and FIG. 3, they are not to be repeated herein.

Figure 12:
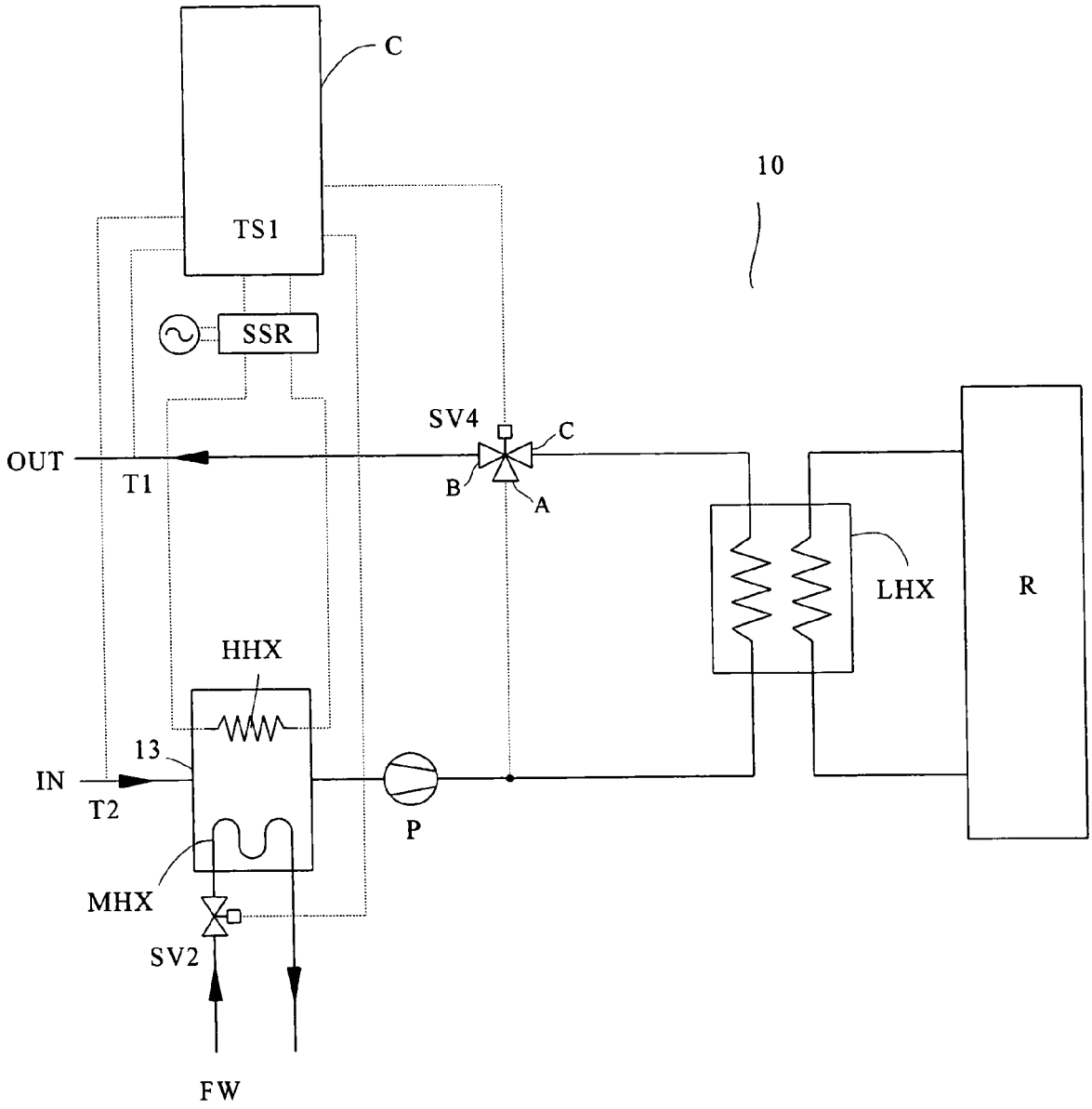
FIG. 12 shows a plot plan of a constant temperature refrigeration system for extensive temperature range application controlled by the present controlling method according to the third embodiment of the present invention, which is similar to the first example shown in FIG. 1.
Figure 13:
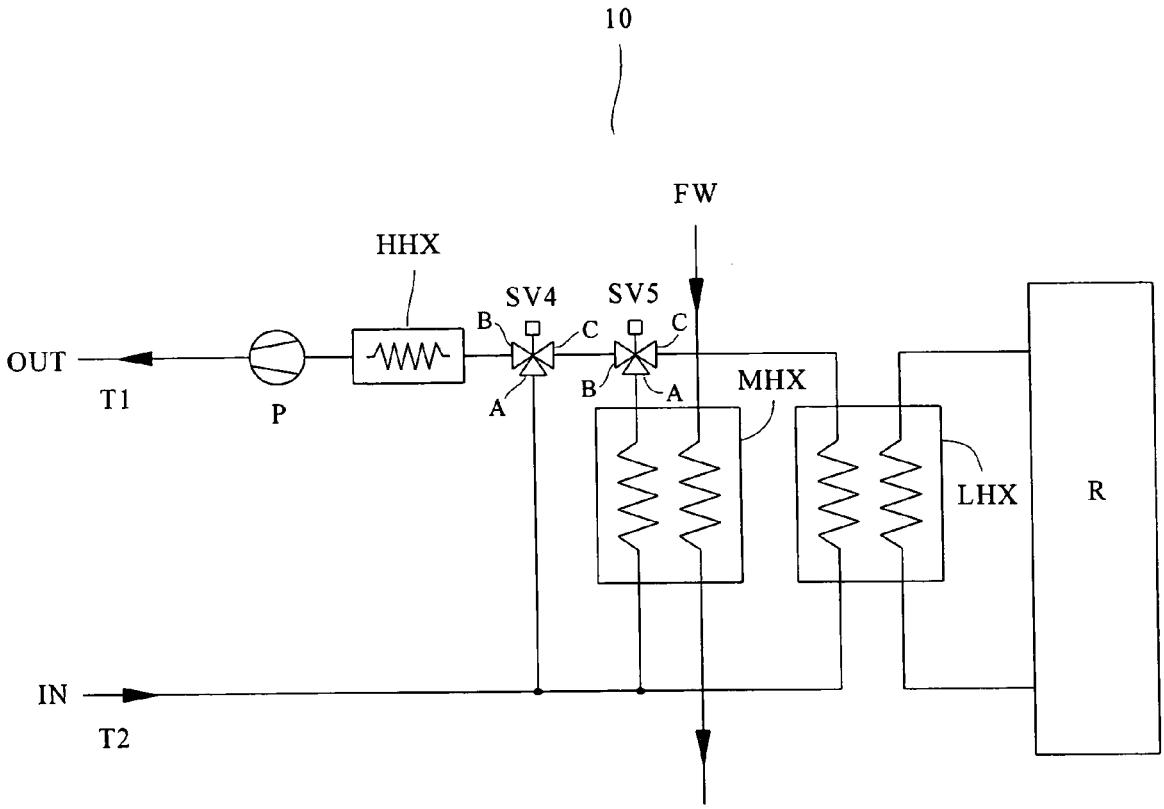
FIG. 13 shows a plot plan of a constant temperature refrigeration system for extensive temperature range application controlled by the present controlling method according to the fourth embodiment of the present invention, which is similar to the second example shown in FIG. 2.
Figure 14:
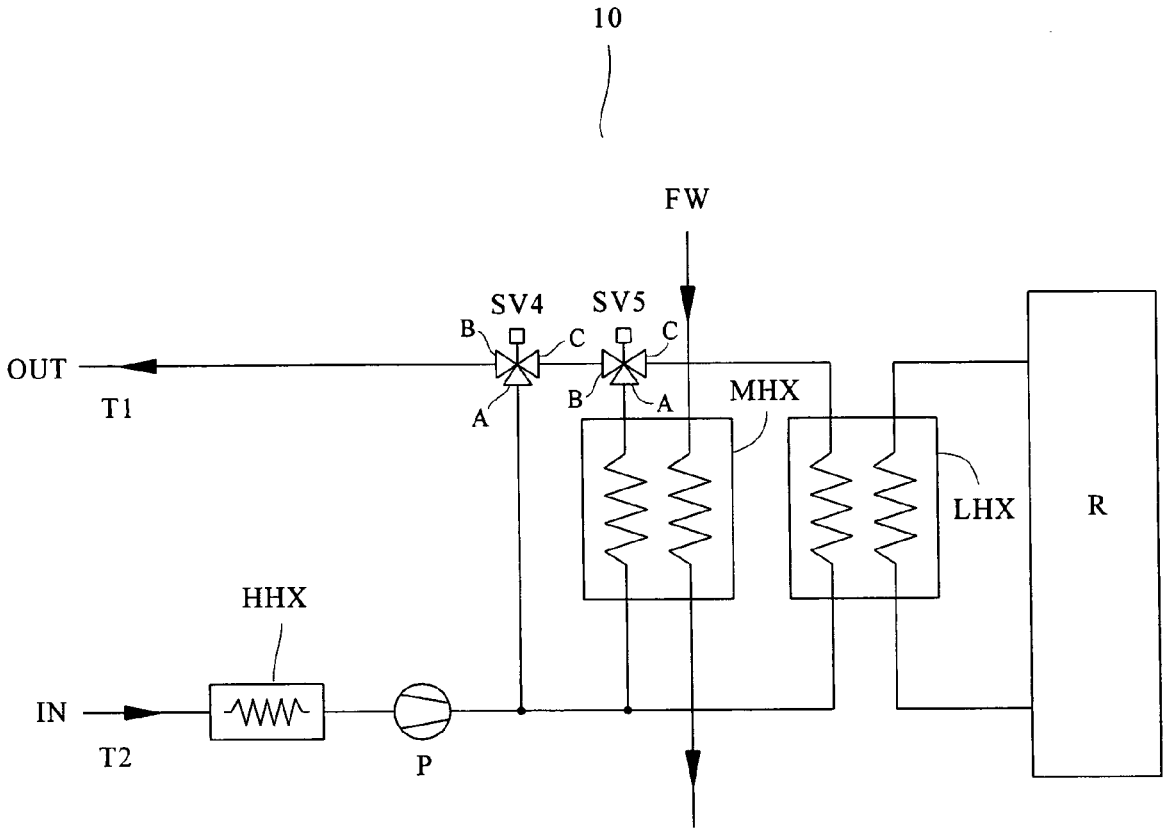
FIG. 14 shows a plot plan of a constant temperature refrigeration system for extensive temperature range application controlled by the present controlling method according to the fifth embodiment of the present invention, which is similar to the third example shown in FIG. 3.
Figure 15:
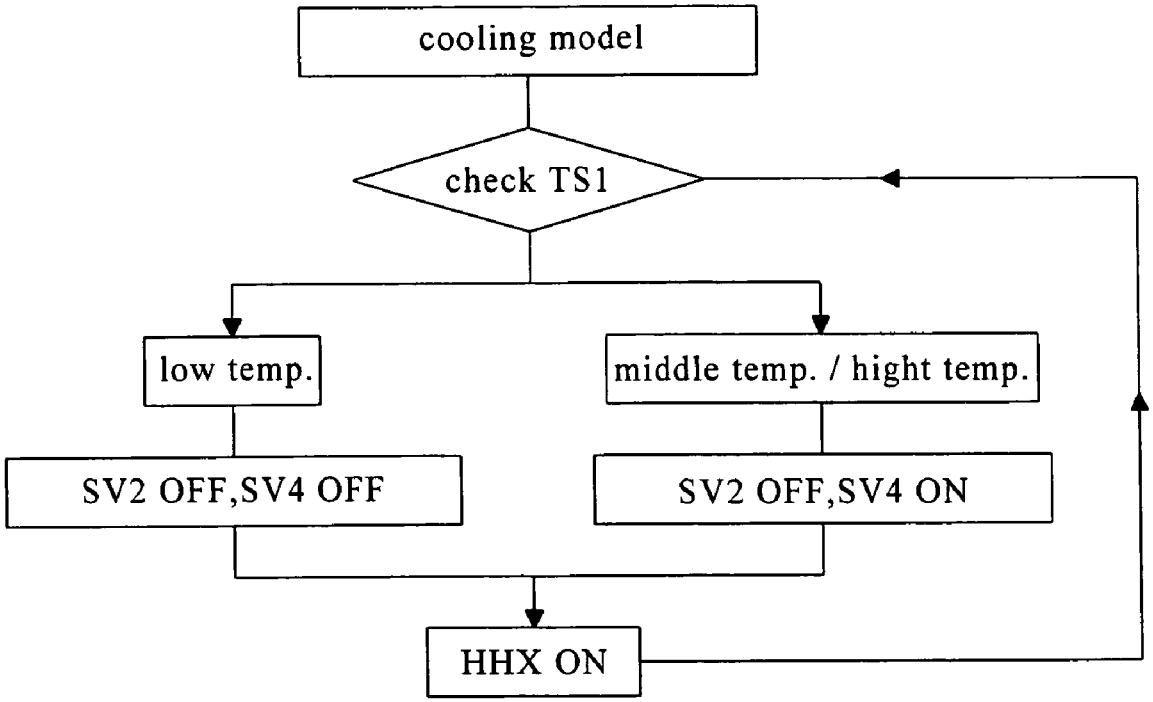
FIG. 15 shows a flow chart of a cooling model for the controlling method of the present invention, which is applied in the third embodiment shown in FIG. 12.
Figure 16:
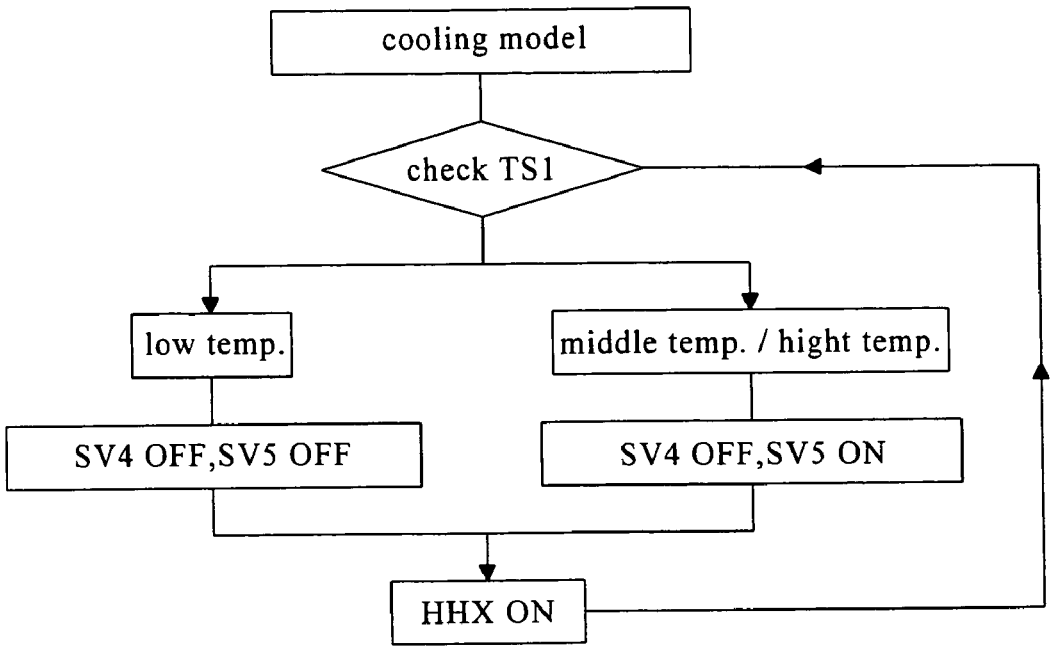
FIG. 16 shows a flow chart of another cooling model for the controlling method of the present invention, which is applied in the fourth embodiment in FIG. 13, the fifth embodiment shown in FIG. 14, the sixth embodiment shown in FIG. 18 and the seventh embodiment in FIG. 20.
Figure 17:
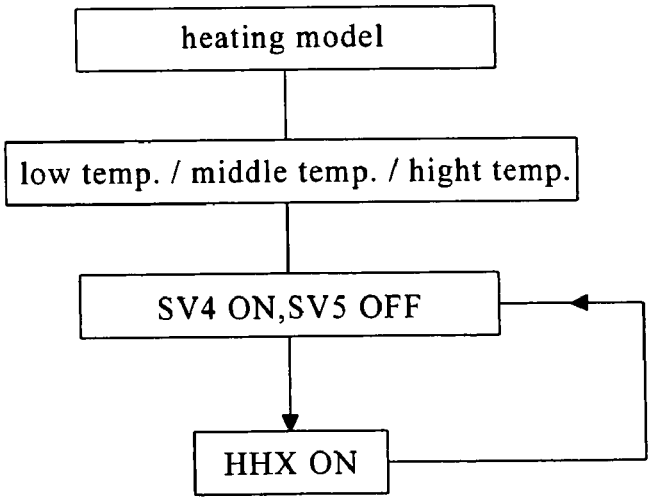
FIG. 17 shows a flow chart of a heating model for the controlling method of the present invention, which is applied in the third embodiment in FIG. 12, the fourth embodiment shown in FIG. 13, the fifth embodiment shown in FIG. 14, the sixth embodiment shown in FIG. 18 and the seventh embodiment in FIG. 20.

Please refer to the third embodiment in FIG. 12, wherein a three-way solenoid valve 4 and the connecting conduits thereof are used for replacing the conventional first and third solenoid valves SV1 and SV3 and related conduits in FIG. 1. Please continue refer to the fourth embodiment in FIG. 13, wherein the three-way solenoid valves SV4 and SV5 and the connecting conduits thereof are used for replacing the conventional first, second and third solenoid valves SV1, SV2 and SV3 and related conduits in FIG. 2. Please continue refer to the fifth embodiment in FIG. 14, wherein the three-way solenoid valves SV4 and SV5 and the connecting conduits thereof are used for replacing the conventional first, second and third solenoid valves SV1, SV2 and SV3 and related conduits in FIG. 3.

The actuating principles for the three-way solenoid valves SV4 and SV5 are as follows: while power is provided for SV4 and SV5 to be under ON mode, the C and B ends are disconnected (circuit disconnected) whereas the A and B ends are connected; while power is discontinued for SV4 and SV5 to be under OFF mode, the C and B ends are connected whereas the A and B ends are disconnected (circuit disconnected). Therefore, as the third embodiment in FIG. 12 proceeds to the control of the cooling model, the object of control can be achieved by referring to that in FIG. 15 wherein the ON or OFF mode for the second solenoid valve SV2 or the three-way solenoid valve SV4 is controlled. By the same token, as the fourth embodiment in FIG. 13 and the fifth embodiment in FIG. 14 proceed to the control of the cooling model, the object of control can be achieved by referring to that in FIG. 16 wherein the ON or OFF mode for the three-way solenoid valve SV4 or the three-way solenoid valve SV5 is controlled. Please refer to FIG. 17 for the heating model in the third embodiment in FIG. 12, the fourth embodiment in FIG. 13 and the fifth embodiment in FIG. 14. Since each embodiment and the controlling model or controlling method shown from FIG. 12 to FIG. 17 are all similar to related elaborations for the conventional FIG. 1 to FIG. 7, they are not repeated herein.

Figure 18:
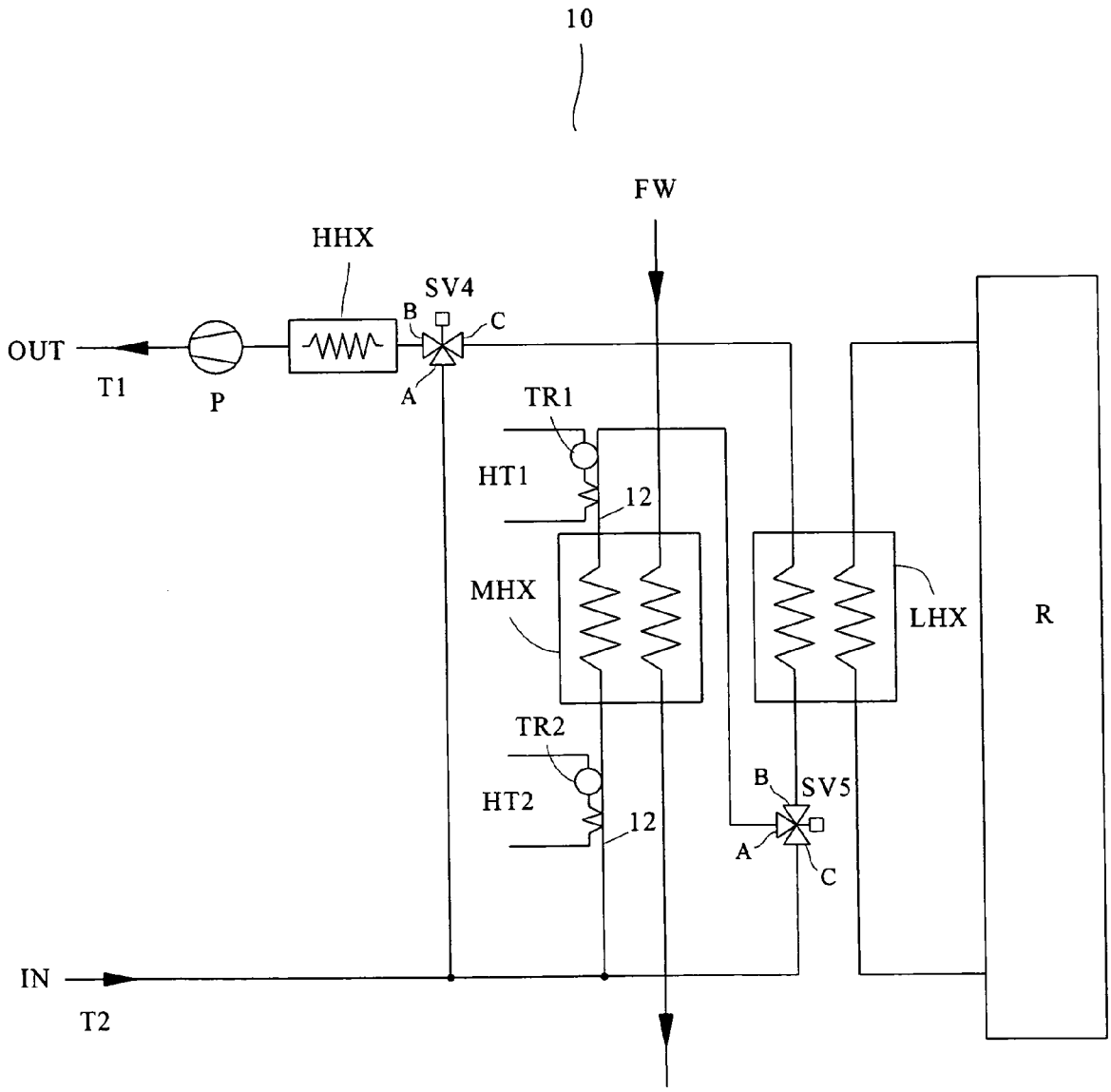
FIG. 18 shows a plot plan of a constant temperature refrigeration system for extensive temperature range application controlled by the present controlling method according to the sixth embodiment of the present invention, which is similar to the first embodiment shown in FIG. 8.
Figure 19:
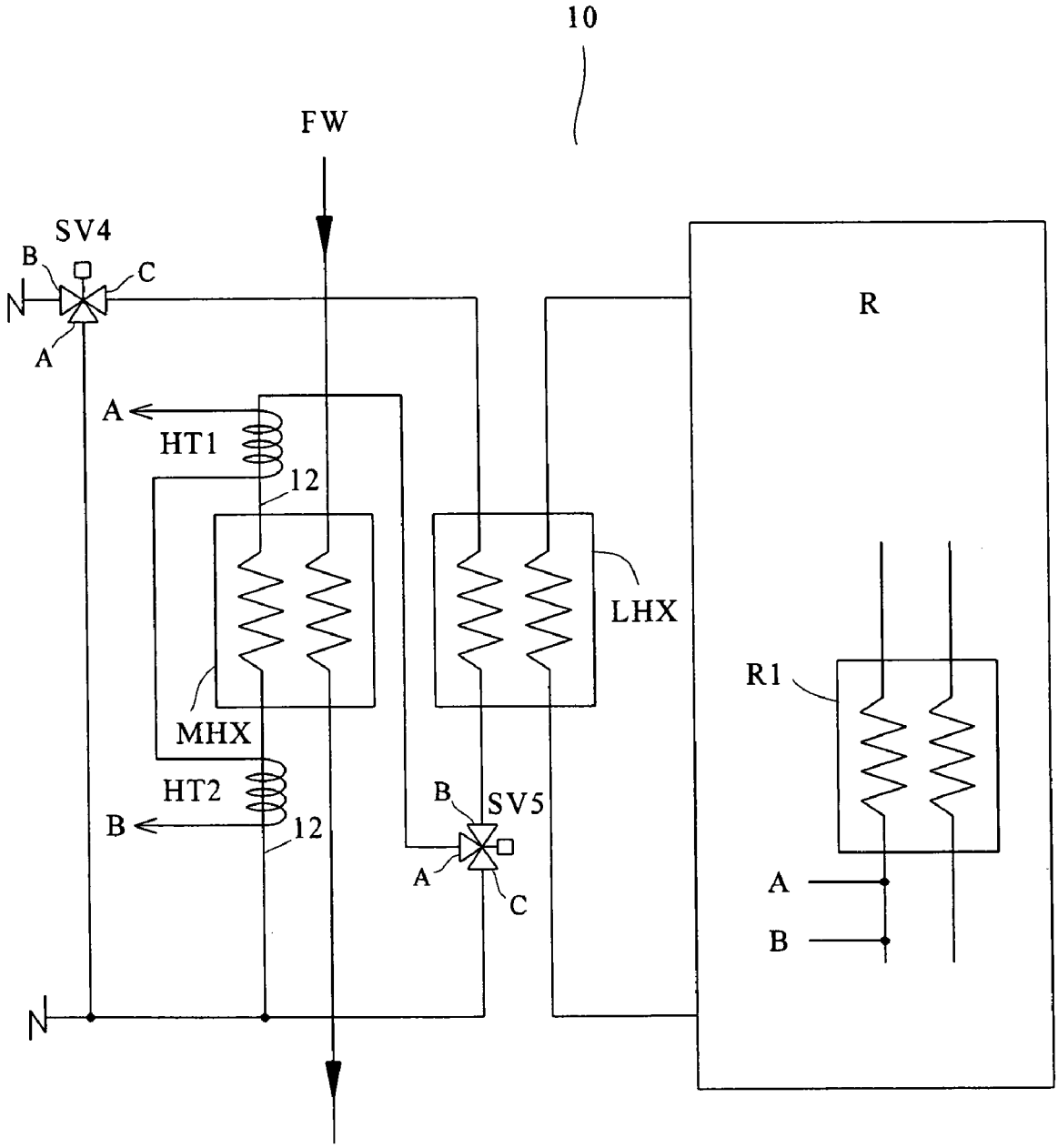
FIG. 19 shows another embodiment shown in FIG. 18.
Figure 20:
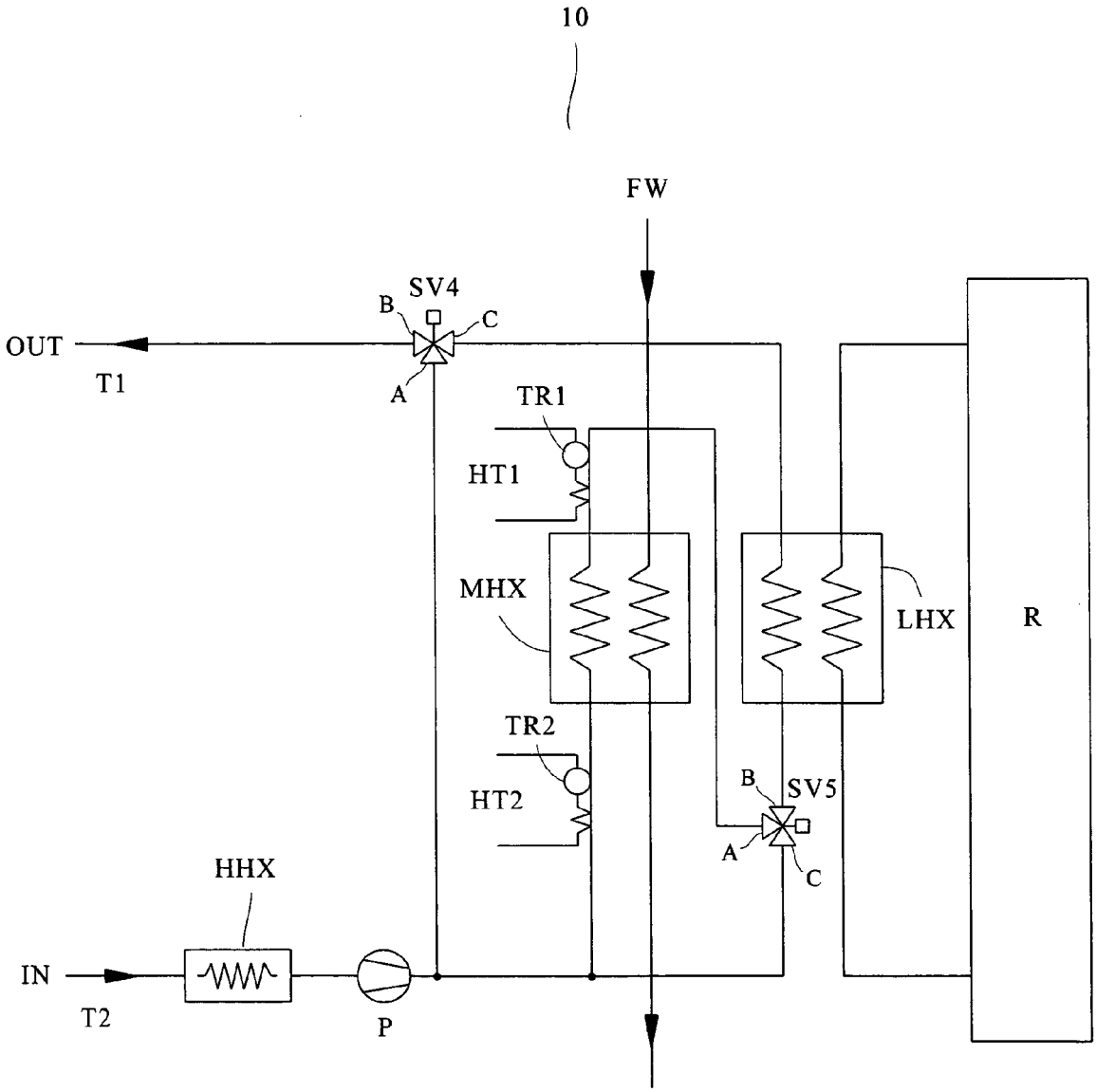
FIG. 20 shows a plot plan of a constant temperature refrigeration system for extensive temperature range application controlled by the present controlling method according to the seventh embodiment of the present invention, which is similar to the second embodiment shown in FIG. 11.

The sixth embodiment in FIG. 18 is similar to the first embodiment in FIG. 8, another embodiment shown in FIG. 19 for the heater 10 in FIG. 18 is identical to the embodiment in FIG. 9, and the seventh embodiment in FIG. 20 is similar to the second embodiment in FIG. 11, embodiments that can all be substantively understood via the foregoing embodiments. Please refer to FIG. 16, FIG. 17 and the conventional FIG. 7 for the cooling models, the heating models and the controlling methods of the embodiments from FIG. 18 to FIG. 20.

The high-temperature heat exchanger HHX in each embodiment is a heater that is constantly under ON mode as the refrigeration system 10 is turned on, and the temperature thereof can be automatically adjusted via the power regulator according to variations of temperature.

As the temperature requirement for the working fluid to be medium or high temperature, the refrigerator R in the refrigeration system 10 is intermittently turned on and off so as to assure the smooth operation of the refrigeration system 10 under wider range of temperature conditions in the long haul.

The low temperature (−40° C. to 25° C.), medium temperature (25° C. to 50° C.) or high temperature (50° C. to 100° C.) referred to in the present invention need not to be clearly defined, thus the coolant and refrigerators should be chosen according to different needs of users.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A method for controlling a constant temperature refrigeration system for extensive temperature range application, comprising steps as follows:

a. predetermine the temperature of a working fluid needed for said refrigeration system;

b. actuate a pump, whereby said working fluid and facility water are respectively introduced into said refrigeration system;

c. compare the differences between the inputting temperature, the outputting temperature and said predetermined temperature of said working fluid; and d. control the ON/OFF of each of solenoid valves of low, medium and high temperature heat exchangers; and e. heat or cool said working fluid by controlling said solenoid valves, such that the outputting temperature of said working fluid is to reach said predetermined temperature required by manufacturing processes.

2. The method as in claim 1, wherein a refrigerator is utilized for providing a cooling source lower than 25° C. during low-temperature application.

3. The method as in claim 1, wherein a facility water having the temperature higher than 25° C. is utilized as a cooling source during medium-temperature application.

4. The method as in claim 1, wherein said high-temperature heat exchanger is utilized during high-temperature application, said high-temperature heat exchanger being constantly under "ON" state after said refrigeration system is actuated, and said power regulator being utilized for fine-tuning the temperature with reference to said temperature differences from said temperature sensor, so as to achieve the accurate constant temperature control.

5. The method as in claim 1, wherein the refrigerator in the refrigeration system is intermittently turned on and off as the temperature requirement for said working fluid is to be medium or high temperature.

* * * * *